US006317083B1

(12) United States Patent
Johnson et al.

(10) Patent No.: US 6,317,083 B1
(45) Date of Patent: Nov. 13, 2001

(54) ANTENNA HAVING A FEED AND A SHORTING POST CONNECTED BETWEEN REFERENCE PLANE AND PLANAR CONDUCTOR INTERACTING TO FORM A TRANSMISSION LINE

(75) Inventors: Alan Johnson, Camberley; Joseph Modro, Hants, both of (GB)

(73) Assignee: Nokia Mobile Phones Limited, Espoo (FI)

( * ) Notice: Subject to any disclaimer, the term of this patent is extended or adjusted under 35 U.S.C. 154(b) by 0 days.

(21) Appl. No.: 09/355,019

(22) Filed: Jul. 16, 1999

Related U.S. Application Data

(63) Continuation of application No. PCT/EP99/03715, filed on May 28, 1998.

(30) Foreign Application Priority Data

May 29, 1998 (GB) ..... 116692/98

(51) Int. Cl.[7] ..... H01Q 1/38

(52) U.S. Cl. ..... 343/700 MS; 343/702; 343/846

(58) Field of Search ..... 343/829, 830, 343/846, 700 MS, 702

(56) References Cited

U.S. PATENT DOCUMENTS 4,701,763 * 10/1987 Yamamoto et al. ..... 343/700 MS
5,268,702 12/1993 Amano .
5,631,660 5/1997 Higashiguchi .
5,764,190 * 6/1998 Murch et al. ..... 343/702
5,896,109 * 4/1999 Hachiga et al. ..... 343/702
6,034,636 * 3/2000 Saitoh ..... 343/700 MS
6,081,728 * 6/2000 Stein et al. ..... 455/523

FOREIGN PATENT DOCUMENTS

720252A1 7/1996 (EP) .
2191045A 12/1987 (GB) .

* cited by examiner

*Primary Examiner*—Don Wong
*Assistant Examiner*—Ephrem Alemu
(74) *Attorney, Agent, or Firm*—Antonelli, Terry, Stout & Kraus, LLP

(57) ABSTRACT

An antenna comprises a reference plane 204, a conductive polygonal lamina 202 disposed opposing the reference plane, and a feed section 206 coupled to the reference plane and the lamina. The feed section 206 is arranged as a transmission line. The feed section may comprise at least two planar conductors 208 arrange parallel to each other, one of the planar conductors 208*b* being connected to the feed and the other of the conductors 208*a* being connected to the reference. The feed section may be in the form of a coplanar strip.

25 Claims, 4 Drawing Sheets

ANTENNA HAVING A FEED AND A SHORTING POST CONNECTED BETWEEN REFERENCE PLANE AND PLANAR CONDUCTOR INTERACTING TO FORM A TRANSMISSION LINE

This is a Continuation of International Application PCT EP99/03715, with an international filing date of May 28, 1998.

This invention relates to antennas and in particular to flat plate or planar antennas.

As electronics and communications technologies have advanced, there has been a drive to increase the performance and decrease the size of consumer devices. In particular, in the field of mobile communications, there has been continual demand for increasingly smaller communications devices, such as telephones, computers and personal organisers, but without a decrease in performance.

One area in which size and weight design goals may be counter to performance design goals is in the design of antennas. The performance of an antenna can be measured by various parameters such as gain, specific absorption rate (SAR), impedance bandwidth and input impedance. Conventionally, mobile telephones have been provided with a rod antenna. These provide good performance relative to cost. However, since the antennas extend from the housing of the device, they are prone to breakage. Furthermore, as the size of a rod antenna decreases, the gain also decreases which is undesirable. As communication devices become smaller, rod antennas are therefore unlikely to provide a convenient antenna solution.

It is desirable therefore to develop an antenna which could be located within the device. An example of such an antenna is a flat plate or low profile antenna such as planar inverted-F antennas (PIFAs) which are well known in antenna art. A PIFA comprises a flat conductive sheet supported a height above a reference voltage plane such as a ground plane. The sheet may be separated from the reference voltage plane by an air dielectric or supported by a solid dielectric. A corner of the sheet is coupled to the ground via a grounding stub and provides an inductive load to the sheet. The sheet is designed to have an electrical length of $\pi/4$ at the desired operating frequency. A feed is coupled to an edge of the flat sheet adjacent the grounded corner. The feed may comprise the inner conductor of a coaxial line. The outer conductor of the coaxial line terminates on and is coupled to the ground plane. The inner conductor extends through the ground plane, through the dielectric (if present) and to the radiating sheet. As such the feed is shielded by the outer conductor as far as the ground plane but then extends, unshielded, to the radiating sheet.

The PIFA forms a resonant circuit having a capacitance and inductance per unit length. The feed point is positioned on the sheet a distance from the corner such that the impedance of the antenna at that point matches the output impedance of the feed line, which is typically 50 ohms. The main mode of resonance for the PIFA is between the short circuit and the open circuit edge. Thus the resonant frequency supported by the PIFA is dependent on the length of the sides of the sheet and to a lesser extent the distance and the thickness of the sheet.

Planar inverted-F antennas have found particular applications in portable radio devices, e.g. radio telephones, personal organisers and laptop computers. Their high gain and omni-directional radiation patterns are particularly suitable. Planar antennas are also suitable for applications where good frequency selectivity is required. Additionally, since the antennas are relatively small at radio frequencies, the antennas can be incorporated into the housing of a device, thereby not distracting from the overall aesthetic appearance of the device. In addition, placing the antenna inside the housing means that the antenna is less likely to be damaged.

However it is difficult to design a planar antenna that offers performance comparable to that of a rod antenna, in particular as far as the bandwidth characteristics of the device are concerned. Loss in an antenna is generally due to two sources: radiation, which is required; and energy which is stored in the antenna, which is undesirable. Planar antennas have an undesirably low impedance bandwidth.

In accordance with the invention there is provided an antenna comprising a reference plane, a conductive polygonal lamina disposed opposing the reference plane; and a feed section coupled to the reference plane and the lamina, the feed section being arranged as a transmission line.

Since the feed section is arranged as a transmission line (otherwise known as a waveguide), energy is contained and guided between the conductors of the transmission line. This results in a low Q factor and hence a higher impedance bandwidth compared with conventionally-fed planar antennas. The bandwidth is increased considerably while retaining the efficiency, size and ease of manufacture of planar antennas. The feed section should be as low-loss as possible.

At the end of the feed section adjacent the reference plane, the feed section preferably has an impedance which matches the impedance of the feed (typically a 50 Ω line). At the end of the feed section adjacent the lamina, the feed section preferably has an impedance which matches the impedance of the antenna. Thus the feed section acts as an impedance transformer, matching the impedance characteristics of the feed at one end and the characteristics of the radiating lamina at the other. The feed section generally has a graded impedance characteristic along its length and provides an inductive load for the antenna. The impedance advantageously varies along the length of the feed section in a uniform manner.

The feed section generally comprises a first conductor for providing the feed signal to the conductive lamina and a second conductor connected to the reference plane, the first and second conductors together forming a transmission line. Thus the conductors of the feed section are e.m. coupled and operate as a waveguide. The energy is guided along the two conductors rather than being stored in the shorting post connected to the reference plane as is the case with conventional planar antennas. Thus the resulting antenna is very efficient compared with known antennas.

Preferably the width of the two conductors are of a similar order of magnitude.

Preferably the feed section comprises a microstrip line and/or a coplanar strip. In a particularly preferred embodiment, the feed section comprises a first part comprising a microstrip line parallel to the reference plane and a second part comprising a coplanar strip which extends at an angle from the reference plane to the conductive lamina. However, other transmission lines may be used e.g. coaxial line.

Thus an antenna according to the invention has an increased impedance bandwidth compared with known planar antennas without a sacrifice in efficiency. There is little radiation from the feed section because the energy is guided along the conductors of the transmission line feed section. In addition the resulting antenna is easy, and therefore relatively inexpensive, to manufacture.

The first conductor provides an inductive load to the conductive lamina.

The invention will now be described, by way of example only, with reference to the accompanying drawings, in which.

Figure 1:
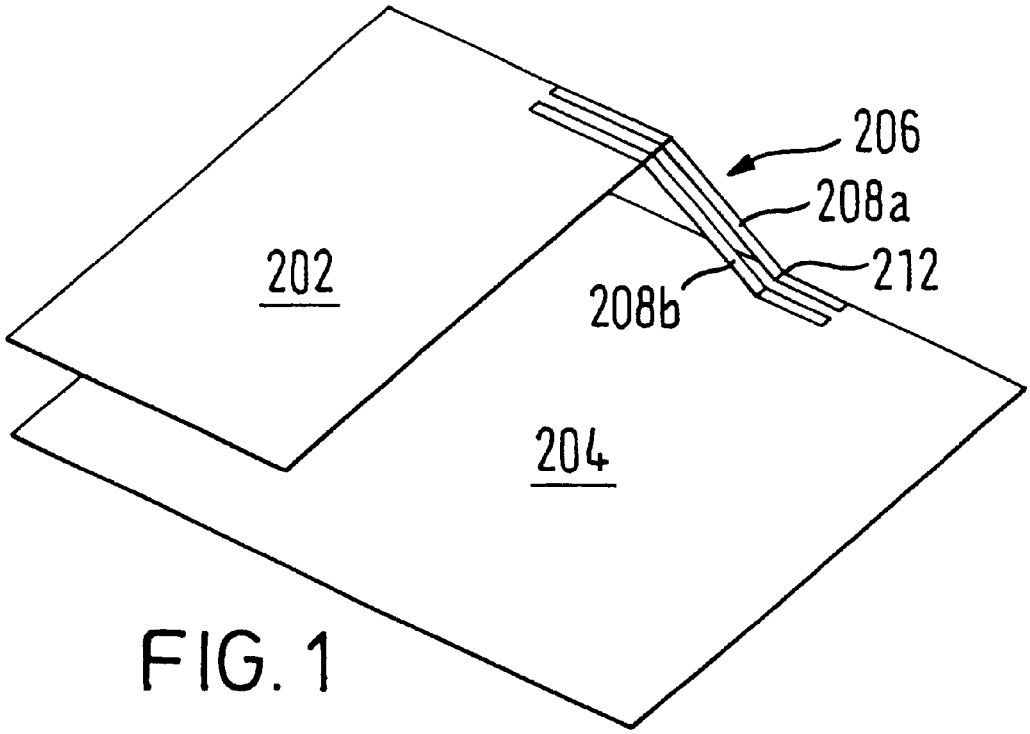
FIG. 1 shows a perspective view of one embodiment of an antenna according to the invention.

The antenna 20 of FIG. 1 comprises a lamina 202 made from a conductive material. The lamina is disposed opposing a reference plane 204 which is commonly a ground plane. A feed section 206 provides both the feed to excite the lamina into resonance and also the grounding point of the antenna. The feed section comprises a transmission line having two planar metal conductors 208 and has a first part 206*a* comprising a coplanar coupled strip and second part 206*b* comprising a microstrip transmission line. The conductor 208*a* nearest the edge 210 of the sheet 202 adjacent the feed section is grounded by connection to the ground plane 204 at the end remote from the sheet 202. The remote conductor 208*b* is the feed. The feed section introduces a propagation mode transition as well as an impedance transition.

The transmission line 206 conveys power from one point (the source of the feed signal) to another (the radiating antenna) and is arranged in such a manner that the properties of the lines must be taken into account i.e the feed section operates as a low-loss waveguide The conductors of the transmission line are close-coupled narrow lines and able to support more than one mode of propagation.

At the end of the feed section 206 adjacent the ground plane 204, the feed section has an impedance which matches the impedance of the line of the ground plane (typically 50 Ω). At the end of the feed section 206 adjacent the lamina 202, the feed section matches the impedance at the feed point of the antenna, typically of the order of 200 Ω. The impedance varies along the length of the feed section in a uniform manner.

Thus feed into the lamina 202 is balanced. In section 206*b* the field is confined between the conductors 208 and the ground plane. In section 206*a* the field is confined between the conductors 208.

The centre frequency of the antenna is determined by the electrical length of the resonant circuit which extends from the open circuit on an edge 214 of the antenna sheet 202, along the feed section 206 and to the point 212 at which the feed section meets the ground plane. This electrical length is usually designed to be a quarter wavelength of the desired frequency.

Figure 2:
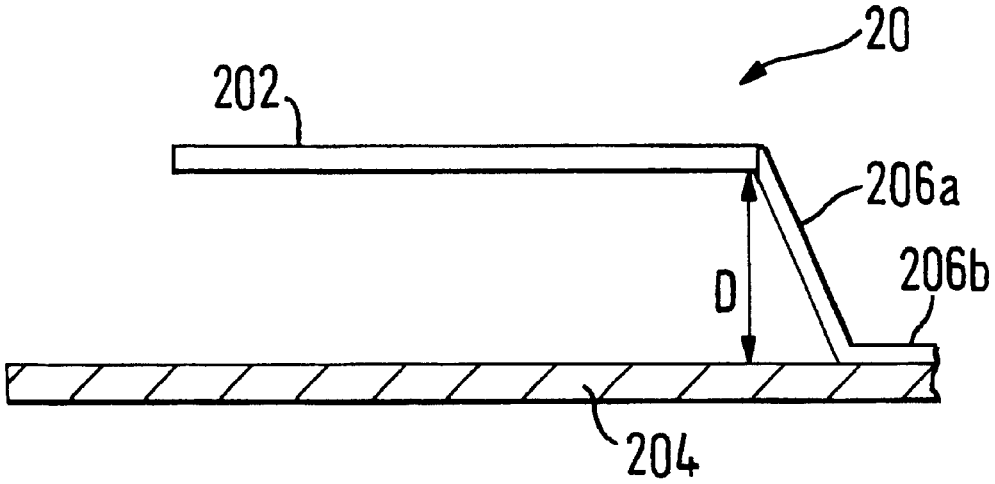
FIG. 2 shows a side view of the antenna of FIG. 1.
Figure 3:
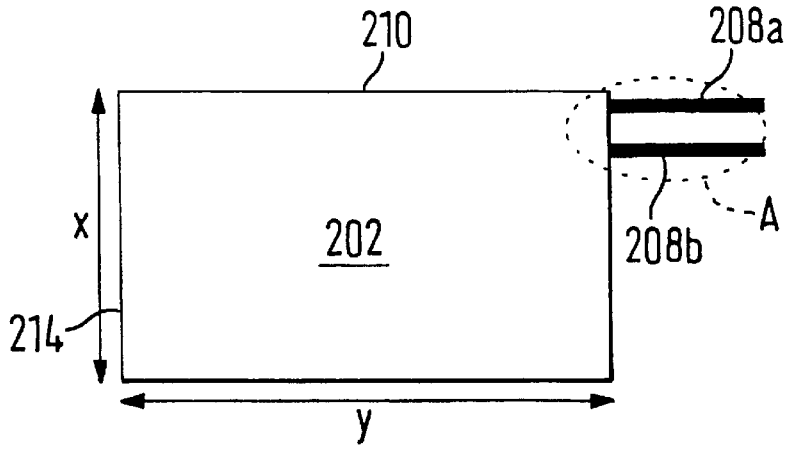
FIG. 3 shows a plan view of the antenna shown in FIG. 1.
Figure 4:
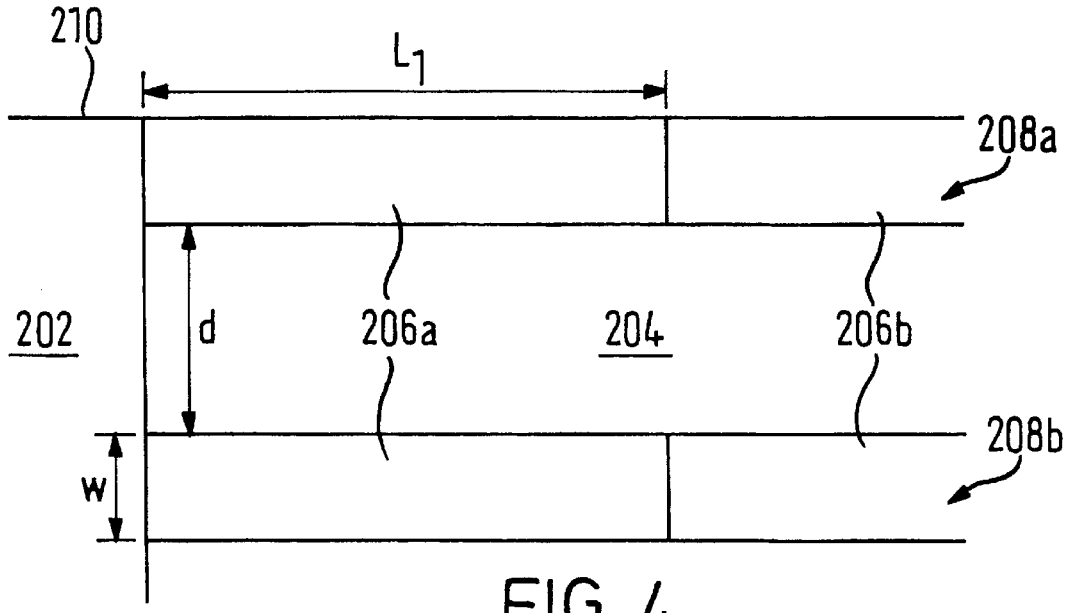
FIG. 4 shows an expanded view of part A of the antenna shown in FIG. 3.

Referring to FIGS. 2, 3 and 4, for an antenna with a resonant frequency of around 1.1 GHz and a sheet 202 having dimensions x=7.8 mm, y=33 mm, the distance D from the ground plane is 8 mm; the width w of the conductors 208 is 0.6 mm; the distance d between the conductors 208 is 0.6 mm; and the length $l_1$ of the first part 206*a* is 11.3 mm. The feed section extends from the ground plane 204 to the lamina 202 at an angle of 45°. For a co-planar strip (CPS) line the track width-to-gap (w,d) measurements may be calculated using well known formulae to achieve the desired impedance transformation. This is also so with other forms of transmission line.

The antenna may be produced using conventional printed circuit board techniques thus making manufacture economical.

The impedance bandwidth of an antenna is calculated as follows:

$$B_Z = B_6dB/f_0 \times 100$$

where $B_z$ is the impedance bandwidth;

B_6dB is the bandwidth at 6dB; and $f_0$ is the centre frequency

Figure 5:
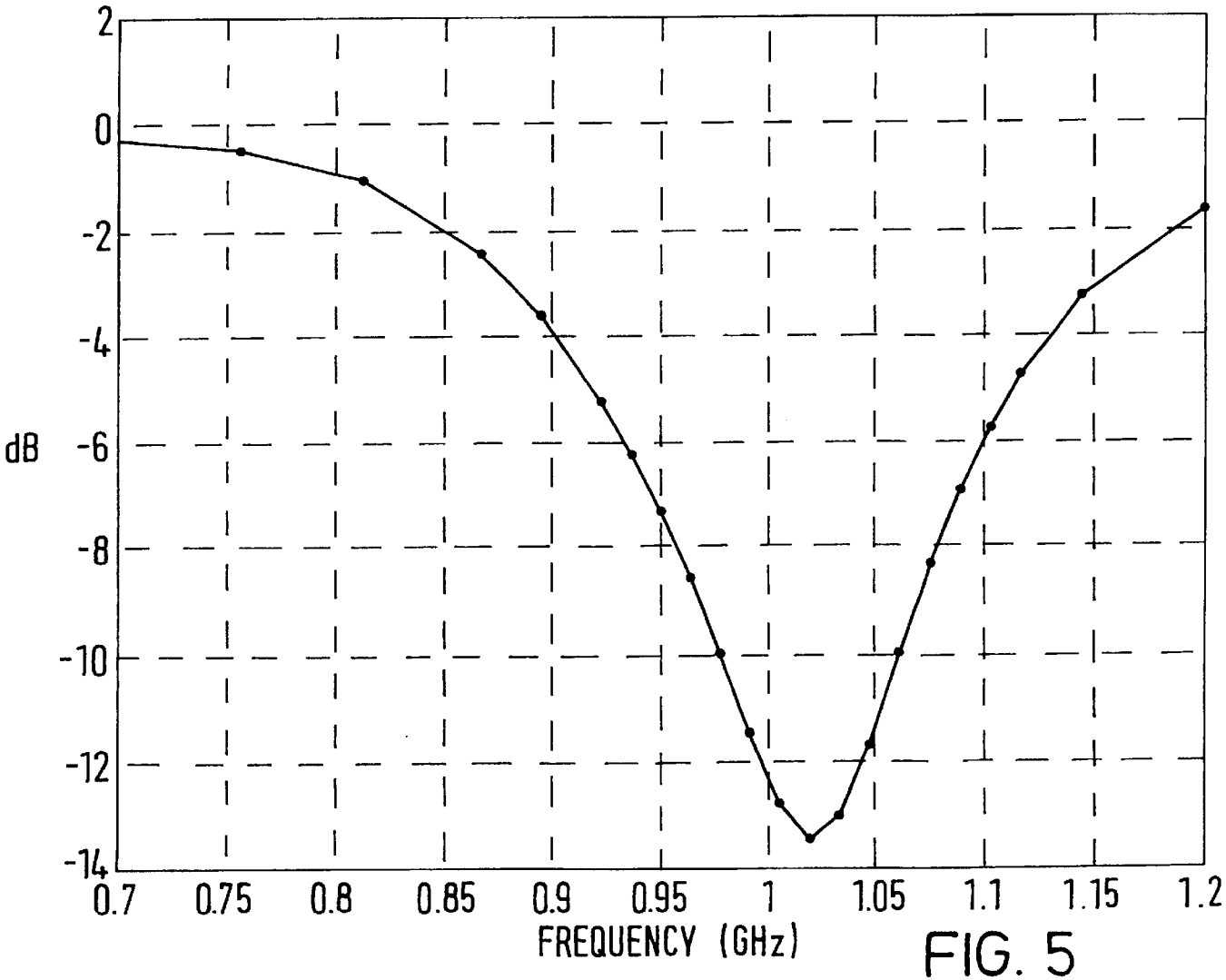
FIG. 5 shows the gain of an antenna according to the invention.
Figure 6A:
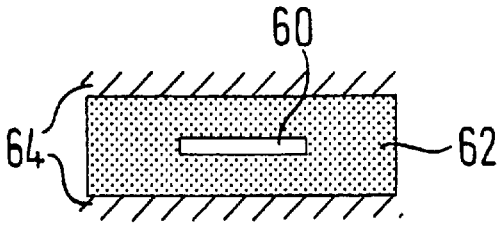
FIG. 6 shows examples of transmission line which may form the feed section of an antenna according to the invention.
Figure 6B:
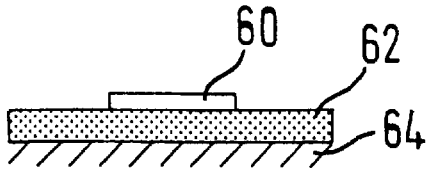
Figure 6C:
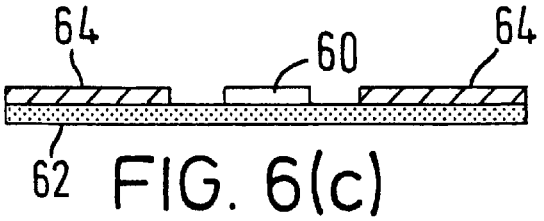
Figure 6D:
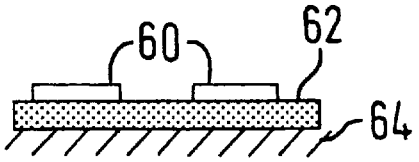

As can be seen in FIG. 5, the bandwidth of the antenna at —6dB is 166 MHz which results in an impedance bandwidth of 16%. This is a substantial increase compared with conventionally fed planar antennas which typically have a maximum impedance bandwidth of around 7%. Using a feed section as described herein has been found to provide an impedance bandwidth of the order of 23% and up to 31% if loading is also used to improve the characteristics.

FIG. 6 shows four examples of strip transmission line which may be used to form the feed section 206. FIG. 6(*a*) shows stripline comprising a conductor 60 embedded within a support of dielectric 62. A reference plane 64 is provided either side of the conductor 60. The electric field is confined between the conductor 60 and the reference planes 64. In this embodiment, the conductor 60 forms the feed and one of the reference planes forms the grounding point as has been described earlier. Thus the plate 202 is connected to the reference plane 64.

FIG. 6(*b*) shows microstrip which comprises a single conductor 60 separated from a ground plane 64 by dielectric 62. The electrical field is confined between the conductor 60 and the reference plane 64. In this embodiment, the conductor 60 forms the feed and the reference plane 64 forms the ground point as has been described earlier. Thus the plate 202 is connected to the reference plane 64.

FIG. 6(*c*) shows a co-planar waveguide which comprises a single conductor 60 located on the surface of a dielectric material 62. Located on either side of the conductor 60 on the surface of the dielectric is a reference plane 64. The electrical field is confined between the conductor 60 and the reference planes 64. In this embodiment, the conductor 60 forms the feed and one of the reference planes forms the ground point as has been described earlier. Thus the plate 202 is connected to the reference plane 64.

FIG. 6(*d*) shows a co-planar strip (CPS) which comprises two conductors 60 located on the surface of a dielectric material 62. Located on the other side of the dielectric 62 is a reference plane 64. The electrical field is confined between the two conductors 60. In this embodiment, one of the conductors 60 forms the feed and the other of the conductors 60 forms the grounding point, an end of which remote from the sheet 202 is coupled to the reference plane 64.

Figure 7:
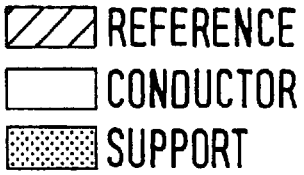
FIG. 7 shows a second embodiment of the invention in which the feed section comprises a coaxial line.
Figure 7:
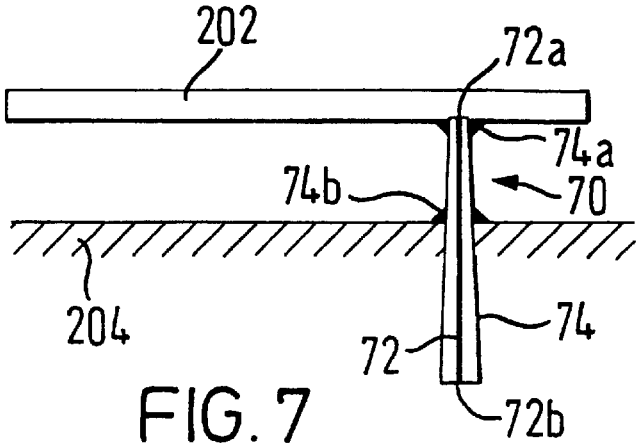

FIG. 7 shows a further embodiment of the feed section. The feed section 70 comprises a coaxial line having an inner conductor 72 and an outer conductor 74. The gap between the inner conductor 72 and the outer conductor 74 is filled with dielectric (not shown). One end 72*a* of the inner conductor 72 is connected to the lamina 202 and the other end 72*b* of the inner conductor 72 is connected to the source of the feed signal (not shown). One end 74*a* of the outer conductor 74 is connected to the lamina 202 and part 74*b* of the outer conductor remote from the end 74*a* is connected to the ground plane 204. The profile of the coaxial cable is graded to provide an impedance transformer. At the end of the feed section 70 adjacent the ground plane 204, the feed section has an impedance which matches that of the feed (typically 50 Ω). At the end of the feed section 70 adjacent the lamina 202, the feed section matches the impedance at the feed point of the antenna, typically of the order of 200 Ω. The impedance preferably varies along the length of the feed section in a uniform manner although a non-uniform variation may be chosen.

What is claimed is:

1. An antenna comprising:

a reference plane;

a conductive polygonal lamina disposed opposing the reference plane; and a feed section extending from the reference plane to the lamina and coupled to the reference plane and the lamina;

wherein the feed section comprises:

a first conductor for providing a feed signal to the conductive lamina, and a second conductor connected to the reference plane, wherein first and second conductors together interact to form a transmission line to contain and guide said feed signal between said first and second conductors.

2. An antenna according to claim 1 wherein the feed section comprises at least two planar conductors arrange parallel to each other, one of the planar conductors being connected to the feed and the other of the conductors being connected to the reference plane.

3. An antenna according to claim 1 wherein the feed section is connected to the conductive lamina adjacent an edge thereof, the conductor adjacent the edge being connected to the reference plane and the conductor remote from the edge being connected to the feed.

4. An antenna according to claim 3 wherein the feed section is connected adjacent a corner edge of the conductive lamina.

5. An antenna according to claim 1 wherein the feed section comprises a stripline.

6. An antenna according to claim 1 wherein the feed section comprises microstrip.

7. An antenna according to claim 1, wherein the feed section comprises two strips coplanar to each other strip.

8. An antenna according to claim 1, wherein the feed section comprises a first part comprising a microstrip line parallel to the reference plane and a second part comprising two strips coplanar to each other which extend at an angle from the reference plane to the conductive lamina.

9. A mobile telephone handset incorporating an antenna according to claim 1.

10. A portable radio device incorporating an antenna according to claim 1.

11. A planar inverted-F comprising:

a planar conductor arranged to resonate at $f=N\lambda/4$, where n is odd;

a shorting post coupled to the planar conductor and a reference plane to provide a short circuit between the planar conductor and the reference plance;

a feed to provide a feed signal to the planar conductor;

wherein the feed and the shorting post are arranged to interact as a transmission line to contain and guide the feed signal between the feed and the shorting post.

12. An antenna according to claim 2 wherein the feed section is connected to the conductive lamina adjacent an edge thereof, the conductor adjacent the edge being connected to the reference plane and the conductor remote from the edge being connected to the feed.

13. An antenna according to claim 3 wherein the feed section is connected to the conductive lamina adjacent an edge thereof, the conductor adjacent the edge being connected to the reference plane and the conductor remote from the edge being connected to the feed.

14. An antenna according to claim 2 wherein the feed section comprises a stripline.

15. An antenna according to claim 3 wherein the feed section comprises a stripline.

16. An antenna according to claim 2 wherein the feed section comprises microstrip.

17. An antenna according to claim 3 wherein the feed section comprises microstrip.

18. An antenna according to claim 2 wherein the feed section comprises two strips coplanar to each other.

19. An antenna according to claim 3 wherein the feed section comprises two strips coplanar to each other.

20. An antenna according to claim 2 wherein the feed section comprises a first part comprising a microstrip line parallel to the reference plane and a second part comprising two strips coplanar to each other which extend at an angle from the reference plane to the conductive lamina.

21. An antenna according to claim 3 wherein the feed section comprises a first part comprising a microstrip line parallel to the reference plane and a second part comprising two strips coplanar to each other which extend at an angle from the reference plane to the conductive lamina.

22. A mobile telephone handset incorporating an antenna according to claim 2.

23. A mobile telephone handset incorporating an antenna according to claim 3.

24. A portable radio device incorporating an antenna according to claim 2.

25. A portable radio device incorporating an antenna according to claim 3.

* * * * *